US009309735B2

(12) United States Patent
Anyan

(10) Patent No.: US 9,309,735 B2
(45) Date of Patent: Apr. 12, 2016

(54) SYSTEM AND METHOD FOR MAINTAINING OPERABILITY OF A DOWNHOLE ACTUATOR

(75) Inventor: Steven L. Anyan, Missouri City, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 1931 days.

(21) Appl. No.: 12/140,368

(22) Filed: Jun. 17, 2008

(65) Prior Publication Data

US 2009/0308607 A1 Dec. 17, 2009

(51) Int. Cl.

| | |
|---|---|
| ***E21B 43/38*** | (2006.01) |
| ***E21B 23/04*** | (2006.01) |
| ***E21B 21/00*** | (2006.01) |
| ***E21B 41/00*** | (2006.01) |

(52) U.S. Cl.

CPC ..... *E21B 23/04* (2013.01); *E21B 21/002* (2013.01); *E21B 41/00* (2013.01); *E21B 43/38* (2013.01)

(58) Field of Classification Search

USPC ..... 166/319, 330, 229; 210/130, 170.01, 210/232, 323.1, 323.2, 354, 356, 420, 210/433.1, 497.01, 747.1, 767, 791

See application file for complete search history.

(56) References Cited

U.S. PATENT DOCUMENTS

| | | | | |
|---|---|---|---|---|
| 3,780,575 | A | 12/1973 | Urbanosky | |
| 4,286,659 | A | 9/1981 | Bolding | |
| 5,174,892 | A * | 12/1992 | Davis | 210/131 |
| 5,269,180 | A | 12/1993 | Dave | |
| 5,281,331 | A * | 1/1994 | Golan | 210/131 |
| 5,738,172 | A * | 4/1998 | van Mook et al. | 166/344 |
| 6,325,150 | B1 | 12/2001 | Rayssiguier | |
| 6,536,519 | B1 | 3/2003 | Vaynshteyn | |
| 6,732,803 | B2 | 5/2004 | Garcia | |
| 6,848,510 | B2 | 2/2005 | Bixenman | |
| 7,188,688 | B1 * | 3/2007 | LeJeune | 175/312 |
| 7,392,839 | B1 * | 7/2008 | Wintill et al. | 166/66.7 |
| 7,704,384 | B2 * | 4/2010 | Stein | 210/131 |
| 2005/0230122 | A1 | 10/2005 | Cho | |
| 2008/0041588 | A1 | 2/2008 | Richards | |
| 2009/0294123 | A1 * | 12/2009 | Mescall et al. | 166/250.01 |

FOREIGN PATENT DOCUMENTS

| | | |
|---|---|---|
| WO | 2001012950 | 2/2001 |
| WO | 2008070271 | 6/2008 |

* cited by examiner

*Primary Examiner* — Elizabeth Gitlin

(74) *Attorney, Agent, or Firm* — David Groesbeck

(57) ABSTRACT

Methods and systems for facilitating actuation of downhole components by filtering actuation fluid and by preventing inoperability due to plugging. A well component is deployed downhole into a wellbore and operated via an actuator moved by a flow of fluid. A filter system is mounted in the flow of fluid to remove debris before the flow of fluid reaches the actuator. The filter system further comprises a pressure release member that opens when sufficient pressure builds up due to plugging of the filter system.

12 Claims, 3 Drawing Sheets

SYSTEM AND METHOD FOR MAINTAINING OPERABILITY OF A DOWNHOLE ACTUATOR

BACKGROUND

In a variety of well applications, valves and other downhole components are actuated hydraulically. Depending on the specific well operation, the hydraulic fluid can be directed to the downhole valve through a tubing string or through the surrounding annulus. In some applications, the activating hydraulic fluid is not isolated from debris, e.g. particulates, which can exist in the wellbore environment. The debris can cause problems related to plugging of the downhole component and/or plugging of the tubing leading to the downhole component. Once plugging occurs, pressure transmission, component activation, and other functional aspects of the well operation can be lost or limited.

One example of a downhole component that can be susceptible to the presence of debris in an actuating fluid is a formation isolation valve. A formation isolation valve is a well suspension/isolation device that, in some applications, can remain in a completion at substantial depth for a prolonged period of time. Due to the deep position and the long suspension period, debris can settle in and around the formation isolation valve and interfere with actuation of the valve by causing plugging and/or mechanical binding that prevents adequate flow of actuating fluid.

SUMMARY

In general, the present invention provides a system and method for facilitating actuation of downhole components and for preventing inoperability due to plugging. A downhole component, such as a formation isolation valve, is moved downhole into a wellbore. The downhole component is operated via an actuator moved by a flow of fluid. A filter system is mounted in the flow of fluid to remove debris before the flow reaches the actuator. The filter system further comprises a pressure release member that opens when sufficient pressure builds due to plugging of the filter system.

BRIEF DESCRIPTION OF THE DRAWINGS

Certain embodiments of the invention will hereafter be described with reference to the accompanying drawings, wherein like reference numerals denote like elements, and.

DETAILED DESCRIPTION

Figure 1:
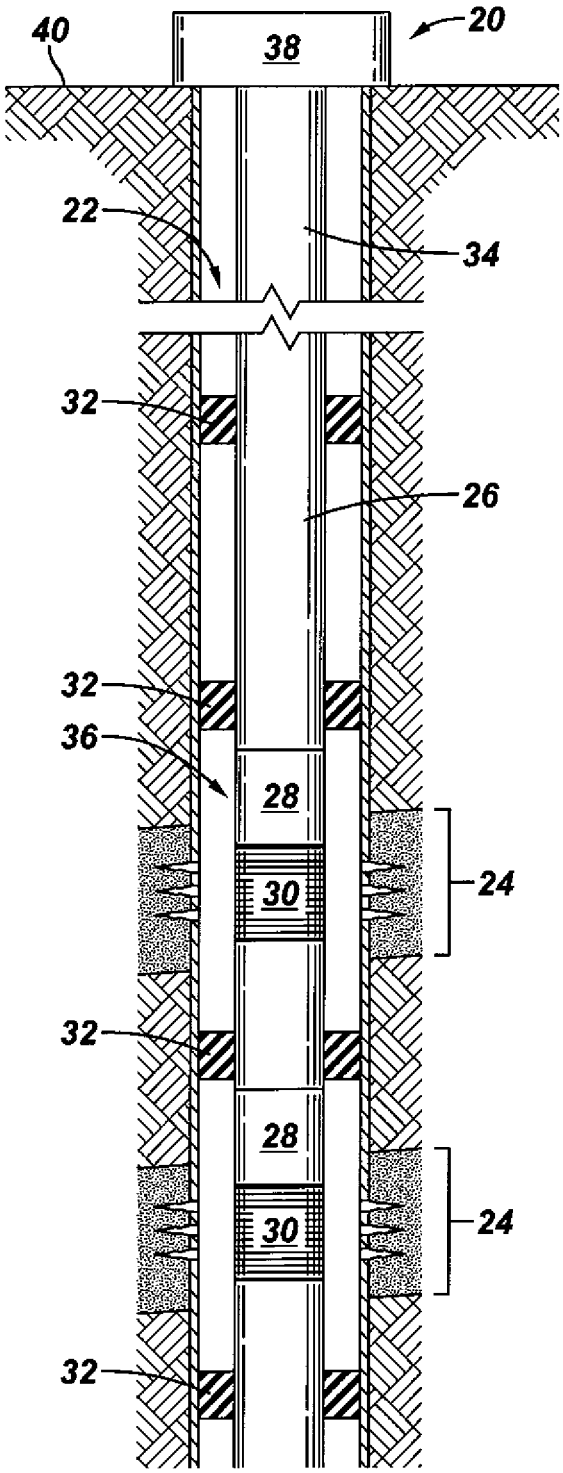
FIG. 1 is a schematic illustration of a well system having a downhole component and a filter system deployed in a wellbore, according to an embodiment of the present invention.

In the following description, numerous details are set forth to provide an understanding of the present invention. However, it will be understood by those of ordinary skill in the art that the present invention may be practiced without these details and that numerous variations or modifications from the described embodiments may be possible.

The present invention generally relates to a system and method for facilitating the actuation of downhole components. Certain downhole components are actuated via fluid that is susceptible to contamination with debris, e.g. particulates, that can affect the operability of the component. In a variety of downhole operations, for example, valves are used to control flow between a tubing string and a surrounding formation. In some cases the flow occurs through a central bore of the tubing string while in other cases the flow occurs through an orifice (e.g., such as holes, porous material, or other form of openings, etc.) located in a side wall of the tubing string, for example. Some of these valves are actuated by a pressurized fluid between different operating configurations. However, the actuating fluid may contain particulates or other debris; or debris can settle on the active portions of the valve. In either case, the particulates or other debris can prevent or limit the desired functionality of the valve.

In one embodiment, the downhole component comprises a formation isolation valve that can be used to protect formations from damage. By isolating a formation, the formation isolation valve can provide a barrier, contain reservoir fluids, and otherwise improve production from the formation. Formation isolation valves use a variety of movable valve elements that are actuated by various techniques. In some applications, for example, the formation isolation valve utilizes a ball valve that can be rotated between open and closed positions based on movement of an actuator by an actuating fluid, e.g. a hydraulic fluid. In still other applications, for example, the formation isolation valve utilizes a flapper or sleeve valve actuated between open and closed positions based on the movement of the actuator by an actuating fluid or other type of actuating force, such as mechanical springs or nitrogen gas, among others.

Hydraulically actuated formation isolation valves are sometimes actuated via hydraulic pressure applied down trough the tubing string or applied through the surrounding annulus. The applied hydraulic pressure is used to move an actuator directly or to cycle an indexer coupled to the valve. The applied hydraulic pressure may also be indirectly applied to an actuator via a piston interacting with a separated quantity of oil. In some embodiments, electronics are used to selectively vent tubing pressure to an internal atmospheric chamber. The differential pressure causes the vented fluid to flow into the internal chamber which acts against a valve actuator and rotates a ball valve or otherwise transitions a valve such as a sleeve, etc., from one configuration to another. However, the tubing fluid can have substantial amounts of contamination which tends to plug flow passages and interfere with the proper function of the valve. The present system filters the debris/contaminants from the activating fluid to facilitate actuation and improve the dependability of operation with respect to the downhole valve or other component. In the event the filtering system becomes plugged, a pressure operated release mechanism is used to enable continued flow of activating fluid in a manner that maintains the ability to properly actuate the downhole component.

Referring generally to FIG. 1, a well system 20 is deployed in a wellbore 22 according to one embodiment of the present invention. The wellbore 22 is illustrated as extending into or through a formation 24, such as a hydrocarbon bearing formation. Well system 20 comprises a well string 26, such as a tubular completion equipment string. The well string 26 comprises one or more well components 28 that are shiftable between different operating configurations. By way of example, the one or more well components 28 may comprise valves that are shifted between open flow and closed flow configurations. In one embodiment, each well component 28 comprises a formation isolation valve used, for example, to protect formation 24 from damage that can result due to fluid lost into the formation or zone of interest during completion and workover operations.

Depending on the specific well related application, well system 20 and well string 26 may comprise a variety of other or additional components. For example, well components 28 in the form of formation isolation valves can be used in cooperation with a variety of other components, including screen sections 30 through which fluid can flow from the tubular well string 26 to the surrounding formation or from the surrounding formation into the tubular well string. Additionally, a plurality of packers 32 can be used to isolate specific well zones along wellbore 22. A conveyance 34, such as a coiled tubing conveyance, production tubing conveyance, or cable-type conveyance, can be used to deploy well components 28 and other components of an overall completion 36 to the desired location or locations within wellbore 22. As illustrated, conveyance 34 extends downwardly from a wellhead 38 positioned at a surface location 40. The conveyance 34 can be used to deliver well components 28 into vertical or deviated wells.

Figure 2:
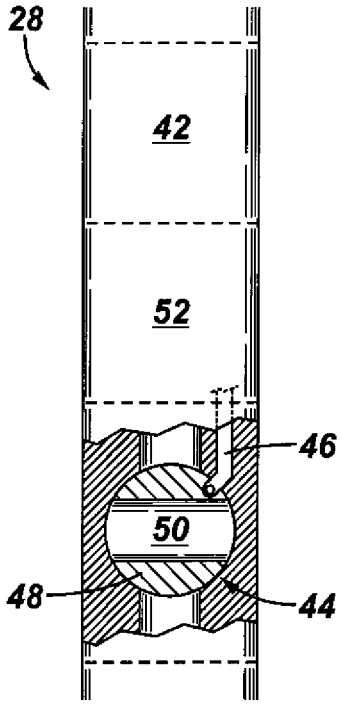
FIG. 2 is a schematic illustration of one example of the downhole component with combined filter system, according to an embodiment of the present invention.

In FIG. 2, one example of a shiftable well component 28 is illustrated as a formation isolation valve 42. The formation isolation valve 42 comprises a valve element 44 that can be moved via an actuator 46 between a plurality of positions, such as an open flow position and a closed flow position. The actuator 46 is acted on by applied fluid pressure, such as hydraulic pressure, to move the valve element 44 between operational configurations. By way of example, valve element 44 may comprise a ball valve 48 rotatable between open flow and closed flow positions. Ball valve 48 comprises a flow passage 50 that can be moved into alignment with tubular well string 26 to allow flow there through or rotated out of alignment, as illustrated, to block flow through the tubular well string. However, a variety of other types of valve elements 44 can be actuated via fluid acting upon actuator 46.

A filter system 52 is positioned to filter a flow of fluid routed to actuator 46 for transitioning the valve element 44. In the specific embodiment illustrated, the filter system 52 is coupled to the formation isolation valve 42 to filter the flow of fluid used in rotating ball valve 48 between flow and no-flow configurations. The filtered fluid may communicate the tubing pressure to hydraulic oil used to directly actuate the formation isolation valve 42, thereby reducing the risk of contaminating moving components with any debris remaining in the filtered fluid. The filter system 52 may be formed as part of formation isolation valve 42, or the filter system 52 may be a separate component cooperating with actuator 46 and valve element 44.

Figure 3:
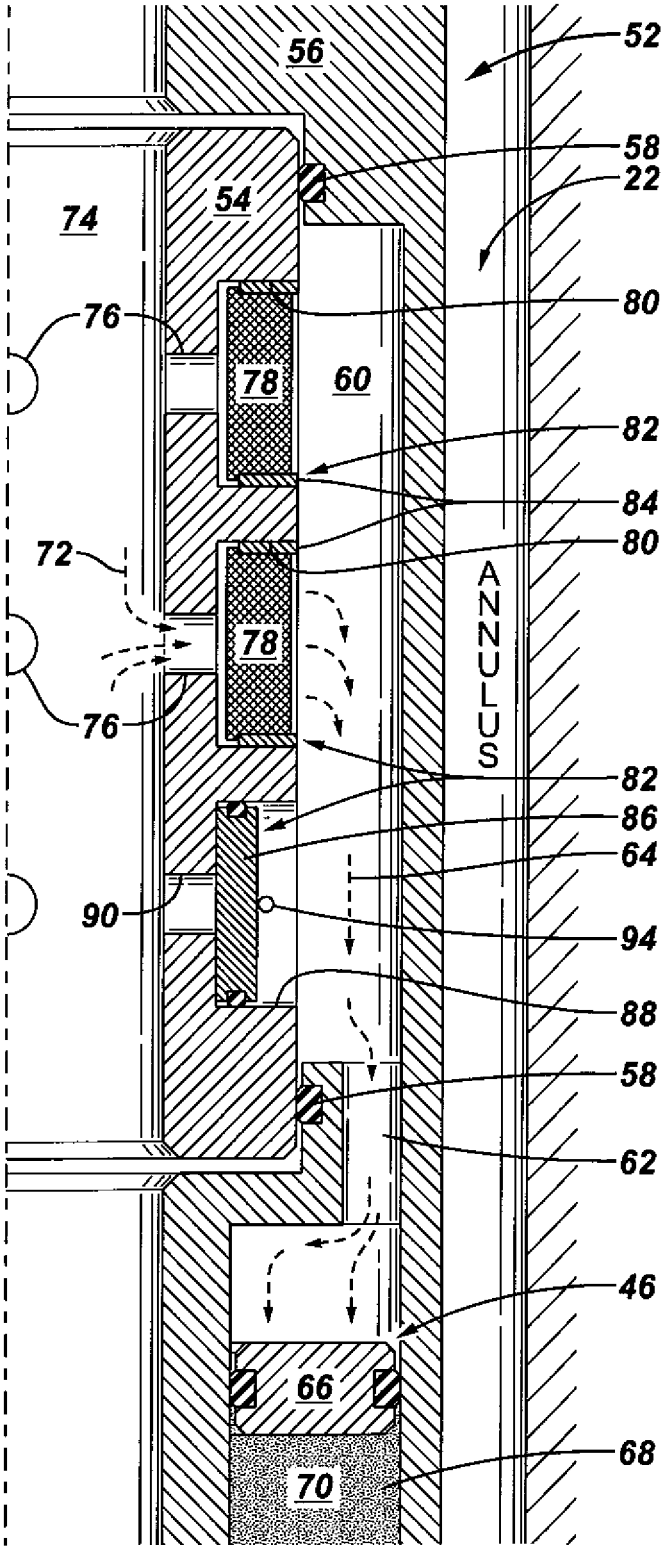
FIG. 3 is a schematic illustration of one example of a system to facilitate the flow of fluid used to actuate the downhole component illustrated in FIG. 1, according to an embodiment of the present invention.

One embodiment of filter system 52 is illustrated in FIG. 3. In this embodiment, filter system 52 is incorporated into well component 28 to filter hydraulic fluid used to actuate the well component. The filter system 52 also maintains the operability of the well components, e.g. formation isolation valves or other types of shiftable downhole components.

In the embodiment illustrated, filter system 52 comprises a filter housing 54 that may be mounted in a component housing 56, such as a housing of formation isolation valve 42. The filter housing 54 is sealingly engaged with component housing 56 via a plurality of seals 58 or close fit to create a filtered fluid chamber 60. Filtered fluid flows into filtered fluid chamber 60 and is directed through a flow channel 62 as indicated by arrows 64. The fluid flowing through filtered fluid chamber 60 and flow channel 62 is under sufficient pressure to move actuator 46. In the example illustrated, actuator 46 may comprise a piston member 66 sealed within a chamber 68 for movement along the chamber 68. The piston member 66 may be mechanically linked to, for example, valve element 44. In other embodiments, piston member 66 can be moved against a fluid 70 which, in turn, moves the valve element 44 or another suitable component element. The fluid 70 may be a hydraulic oil or other suitable incompressible or compressible fluid. By way of specific example, piston member 66 can be linked to ball valve 48 via solid or hydraulic connection to rotate the ball valve upon input of sufficiently pressurized fluid into filtered fluid chamber 60.

Referring again to FIG. 3, the fluid flows to actuator 46 along a flow passage 72 that conducts fluid down through an interior, axial passageway 74 and then outwardly through one or more ports 76 before passing into filtered fluid chamber 60. As illustrated, filter system 52 comprises one or more filters 78 deployed in the flow passage 72 to filter the flow of fluid before it passes into filtered fluid chamber 60. The one or more filters 78 can be mounted in filter housing 54. For example, a plurality of filters 78 can be mounted in recessed portions 80 of filter housing 54 proximate ports 76. As the potentially debris laden fluid passes down through axial passageway 74 and into ports 76, filters 78 remove the particulates and other contaminants before the fluid enters filtered fluid chamber 60. This enables actuation of the formation isolation valve 42 or other downhole component without detrimentally affecting the functionality of the device due to contaminated actuation fluid.

Filter system 52 further comprises one or more pressure release members 82 that automatically open to allow flow if the primary filtering device, e.g. filter 78, completely plugs or reaches a preset pressure drop indicative of plugging. The pressure release member 82 may be combined with one or more of the filters 78 in the form of a release mechanism 84 that allows the corresponding filter 78 to pop-off when a sufficient pressure differential develops. Alternatively or in addition, the pressure release member may comprise a separate pop-off member, such as a removable solid member 86 that is removably mounted in filter housing 54. For example, removable solid member 86 may be mounted in a recess 88 adjacent a pressure release flow port 90 formed through filter housing 54. In the event filters 78 become plugged, a pressure differential builds across removable solid member 86 until the removable solid member 86 is displaced to allow fluid flow to actuator 46.

Accordingly, even if filter 78 becomes inoperable due to plugging, the formation isolation valve or other downhole component can still be actuated by causing rupture/displacement of the one or more pressure release members 82 to enable fluid flow to actuator 46. Individual or multiple release mechanisms 84 can be used alone or in combination with a separate removable member, such as removable solid member 86. Similarly, a separate pressure release member, such as removable solid member 86, can be used alone or in combination with other pressure release members.

Figure 4:
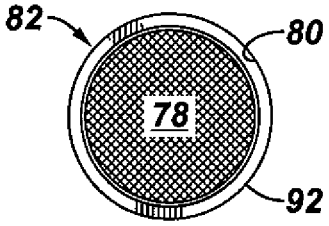
FIG. 4 is a schematic illustration of one embodiment of a filter for use in the filter system illustrated in FIG. 3, according to an embodiment of the present invention.

Pressure release members 82 can be constructed in a variety of forms. In one embodiment, for example, the pressure release member 82 is formed as a ring 92 press fit into the corresponding recessed portion 80, as illustrated in FIG. 4. In a specific example, ring 92 is constructed as a support ring for one (or more) of the filters 78 and press fit into recessed portion 80 to maintain filter 78 in the flow of fluid along flow passage 72. If the filter 78 becomes plugged, pressure builds and creates a pressure differential across the plugged filter 78. The press fit is designed to release when the pressure buildup reaches a predetermined value or range. During normal operation, the pressure differential across the filters 78 and removable solid member 86 is relatively low because the filters 78 are freely passing fluid. However, the pressure differential between passageway 74 and filtered fluid chamber 60 increases as the filters 78 become increasingly plugged. This increased pressure differential forces one or more rings 92 to move relative to the corresponding recessed portions 80, thereby providing fluid communication into filtered fluid chamber 60. In some cases, a ring 92 may completely release from the corresponding recess portion 80 and allow the corresponding filter 78 to enter into the filtered fluid chamber 60. In other cases, a ring 92 may only partially release, resulting in the pivoting of corresponding filter 78 relative to the corresponding recess portion 80 and thereby establishing a fluid communication pathway to the filtered fluid chamber 60. At this stage, unfiltered fluid is allowed to fill chamber 60 and finish moving actuator 46, e.g. piston member 66, to fully actuate the formation isolation valve 42 or other downhole component.

Figure 5:
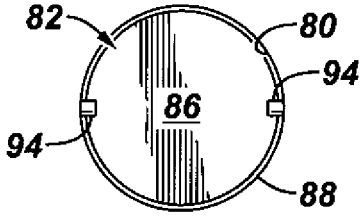
FIG. 5 is a schematic illustration of one example of a pressure relief member that can be used in the system illustrated in FIG. 3, according to an embodiment of the present invention.

In an alternate embodiment, ring 92 can be formed as a shear mechanism that shears to release the filter 78 upon development of the predetermined pressure differential. Ring 92 also can be coupled to filter housing 54 by shear pins or other appropriate shear members. The removable solid member 86 also can be coupled to filter housing 54 by a press fit, shear member, or other suitable attachment mechanism that releases to allow flow under sufficient pressure buildup. As illustrated in FIG. 5, for example, removable solid member 86 is held within its corresponding recess 88 by one or more shear pins 94. In other embodiments, solid member 86 may be spring loaded (not shown) so as to release by pivoting relative to a corresponding recess 88 after sufficient pressure buildup. In still other embodiments, a combination of shear pins 94 and spring loading may be used to secure solid member 86 relative to a corresponding recess 88. Further, removable solid member 86 can be formed as a relatively thin disk, such as a rupture disk, providing substantial space for installation of shear pins 94, for example. As will also be readily appreciated by those of skill in the art, embodiments of the current invention may be configured such that the solid member 86 releases by rupturing, thereby providing a fluid communication pathway between passageway 74 and fluid chamber 60, in place of or in addition to shearing of one or more shear pins 94.

Figure 6:
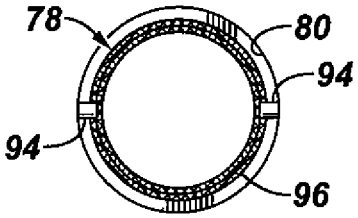
FIG. 6 is a schematic illustration of another example of a filter that can be used in the system illustrated in FIG. 3, according to an alternate embodiment of the present invention.
Figure 7:
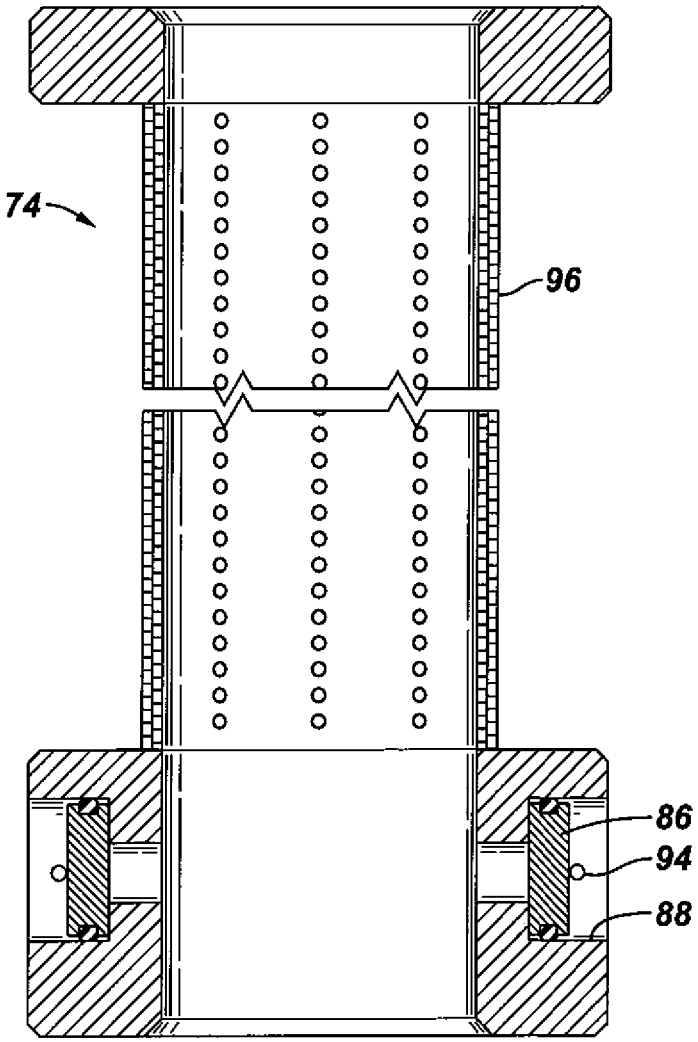
FIG. 7 is a cross-sectional view of another example of a filter that can be used in the system illustrated in FIG. 3, according to an alternate embodiment of the present invention.

Depending on the design of filter system 52 and the required fluid flow through filter 78, the number, arrangement, and type of filters can vary. As illustrated in FIGS. 6 and 7, for example, filter 78 can be formed as a perforated tube filter 96. The perforated tube filter 96 can be formed as a multi-layer design having two or more perforated tubes. In another embodiment, the perforated tube filter 96 can be formed with a perforated tube and an outer layer of screen mesh designed so fluid passes through progressively smaller flow passages, providing a filtering function. It should be noted that the described filters are intended to illustrate exemplary embodiments of the present invention, and are not intended to limit the invention scope. Embodiments of the present invention can be used with all types of fluid flow or filtering systems, such as wire wrap designs, screens, and porous materials, among others. In some applications, the perforated tube filters 96 are used to establish increased flow area per unit length of the filter system. The perforated tube filters 96 can be designed to open, e.g. pop-off, or they can be designed for use with separate pop-off members, such as removable solid members 86.

The well system 20 is designed for well operations utilizing a variety of downhole components shifted by fluid. Additionally, the size, shape and configuration of filter system 52 can be adjusted according to the fluid actuated well component, completion size, and well environment. For example, the number and arrangement of filters may be different from one application to another. Similarly, the number and arrangement of pressure release members can vary. Also, many types of materials and arrangements of materials can be used in constructing the individual filters and pressure release members.

Accordingly, although only a few embodiments of the present invention have been described in detail above, those of ordinary skill in the art will readily appreciate that many modifications are possible without materially departing from the teachings of this invention. Such modifications are intended to be included within the scope of this invention as defined in the claims.

What is claimed is:

1. A system to facilitate an actuating fluid flow for a well component, comprising:

a formation isolation valve that can be actuated by a flow of fluid;

a filter system coupled to the formation isolation valve to filter the flow of fluid during actuation, the filter system comprising a flow passage for conducting the flow of fluid, a filter mounted in the flow passage, and a pressure release member that opens under sufficient pressure to allow continued flow of fluid when the filter becomes plugged, wherein the pressure release member comprises a retention member working in cooperation with the filter to enable the filter to separate from a surrounding housing when exposed to the sufficient pressure; and wherein the pressure release member comprises a ring press fit into the surrounding housing.

2. The system as recited in claim 1, wherein the filter comprises a plurality of filters.

3. The system as recited in claim 1, wherein the filter is a pop-off filter that separates from a surrounding filter housing under sufficient pressure.

4. A system to facilitate an actuating fluid flow for a well component, comprising;

a formation isolation valve that can be actuated by a flow of fluid;

a filter system coupled to the formation isolation valve to filter the flow of fluid during actuation, the filter system comprising a flow passage for conducting the flow of fluid, a filter mounted in the flow passage, and a pressure release member that opens under sufficient pressure to allow continued flow of fluid when the filter becomes plugged, wherein the pressure release member comprises a retention member working in cooperation with the filter to enable the filter to separate from a surrounding housing when exposed to the sufficient pressure; and wherein the pressure release member comprises a removable solid member separate from the filter.

5. The system as recited in claim 4, wherein the filter comprises a plurality of filters.

6. The system as recited in claim 4, wherein the filter is a pop-off filter that separates from a surrounding filter housing under sufficient pressure.

7. A method, comprising:

coupling a filter system to a formation isolation valve;

actuating the formation isolation valve with a fluid directed through the filter system;

filtering the fluid as it passes through the filter system, wherein filtering comprises filtering the fluid with at least one pop-off filter;

maintaining the ability to flow actuating fluid to the formation isolation valve when the filter system becomes plugged by employing a pressure release member that opens upon sufficient buildup of pressure; and wherein maintaining comprises using a filter press fit into a filter housing in a manner that allows removal of the filter upon sufficient buildup of pressure.

8. The method as recited in claim 7, wherein actuating comprises actuating a ball valve.

9. The method as recited in claim 7, wherein actuating comprises directing the fluid down through a tubing string and through the filter system.

10. A method, comprising coupling a filter system to a formation isolation valve;

actuating the formation isolation valve with a fluid directed through the filter system;

filtering the fluid as it passes through the filter system wherein filtering comprises filtering the fluid with at least one pop-off filter;

maintaining the ability to flow actuating fluid to the formation isolation valve when the filter system becomes plugged by employing a pressure release member that opens upon sufficient buildup of pressure; and wherein maintaining comprises using a removable solid member separate from a filter in a manner that allows removal of the removable solid member upon sufficient buildup of pressure.

11. The method as recited in claim 10, wherein actuating comprises actuating a ball valve.

12. The method as recited in claim 10, wherein actuating comprises directing the fluid down through a tubing string and through the filter system.

* * * * *